United States Patent [19]

Arzoumanian

[11] 4,134,337

[45] Jan. 16, 1979

[54] CONCAVE IMPACT PRINT HAMMERS

[75] Inventor: Aram S. Arzoumanian, Encino, Calif.

[73] Assignee: Dataproducts Corporation, Woodland Hills, Calif.

[21] Appl. No.: 805,337

[22] Filed: Jun. 10, 1977

[51] Int. Cl.[2] ..... B41J 9/12

[52] U.S. Cl. ..... 101/93.09; 101/93.14; 101/93.48; 101/111

[58] Field of Search .... 101/93.09, 93.14, 93.29–93.36, 101/93.48, 111, 368, 379

[56] References Cited

U.S. PATENT DOCUMENTS

| | | | |
|---|---|---|---|
| 3,604,347 | 9/1971 | Muterspan | 101/93.09 |
| 3,850,097 | 11/1974 | Sweeney | 101/93.09 |
| 3,967,551 | 7/1976 | Matsubara et al. | 101/93.48 |
| 3,981,236 | 9/1976 | Johnston et al. | 101/93.48 X |
| 3,994,219 | 11/1976 | Yasuda et al. | 101/93.09 |

OTHER PUBLICATIONS

Bogaczyk et al., IBM Tech. Disclosure Bulletin, vol. 17, No. 5, 10/1974, p. 1317.

*Primary Examiner*—Edward M. Coven

[57] ABSTRACT

Print smearing observed in double wide hammers can be controlled and reduced by providing the impact face of the print hammer with a concave cylindrical radius of curvature wherein the cylindrical axis is parallel to the vertical font direction. The radius of curvature is chosen according to impact energy and font velocities. In other embodiments, the timing of impact between the hammer and font characters may be offset such that the center of the print column leads the center of the impact hammer at the time of impact. In another embodiment, the radius of cylindrical curvature may be ground off center from the center line of the print hammer by a predetermined offset.

5 Claims, 17 Drawing Figures

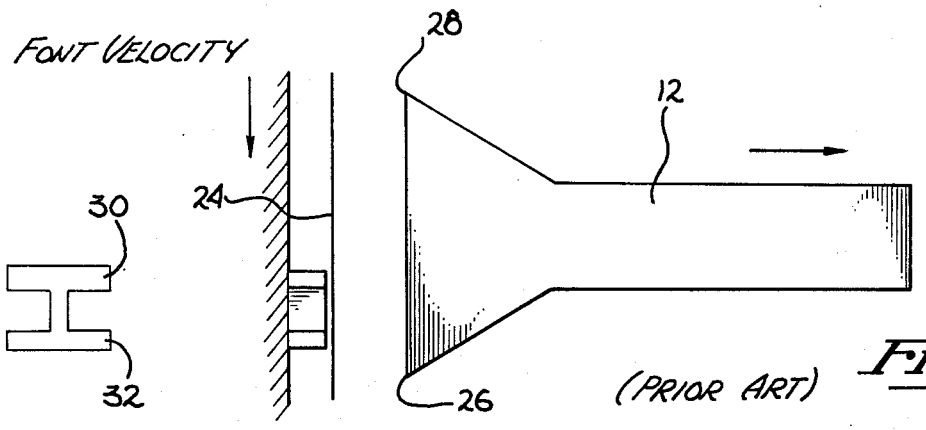
(PRIOR ART) Fig. 2d
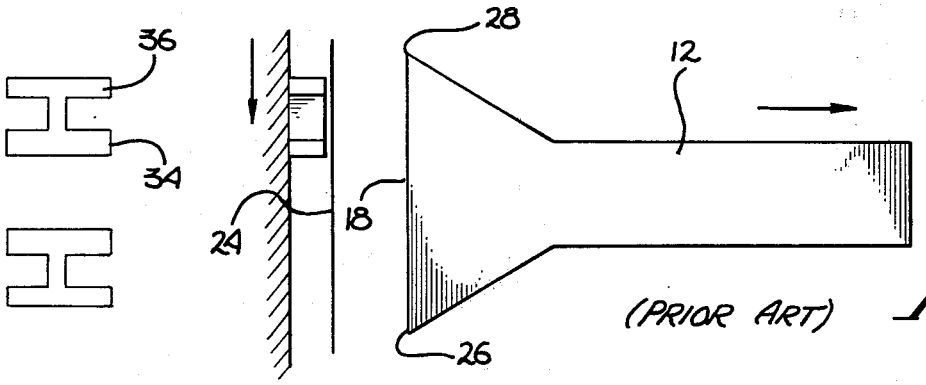
(PRIOR ART) Fig. 2e
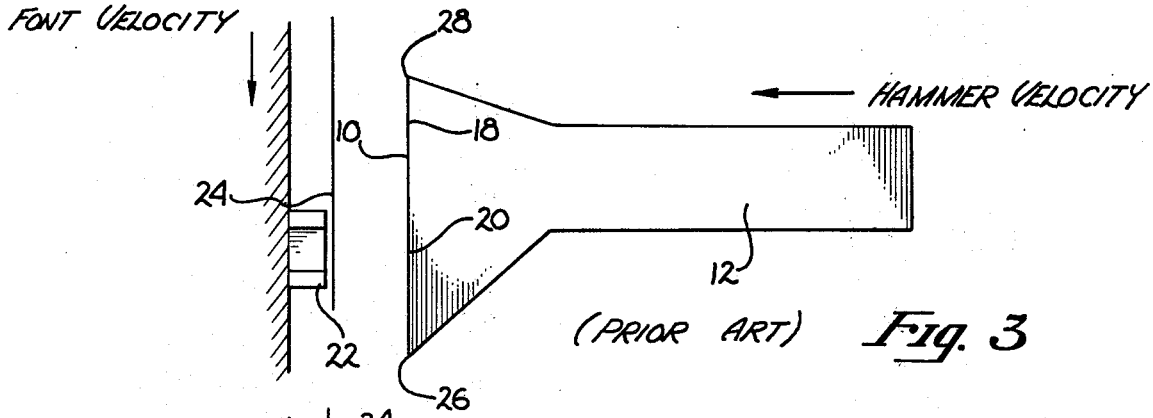
(PRIOR ART) Fig. 3
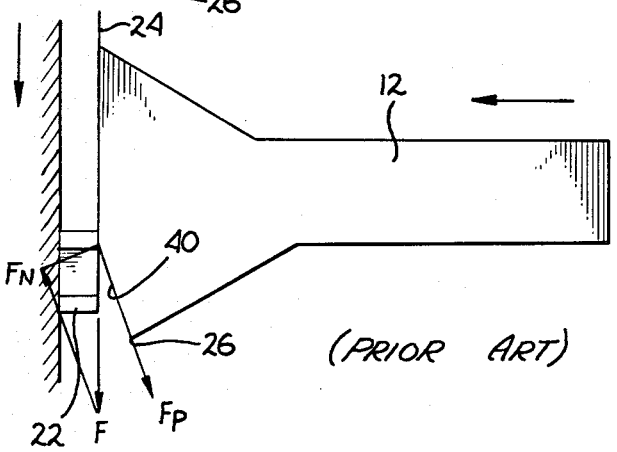
(PRIOR ART) Fig. 4

CONCAVE IMPACT PRINT HAMMERS

BACKGROUND OF THE INVENTION

1. Field of the Invention

The present invention relates to the field of impact printers and in particular, relates to hammer face design for impact hammers.

2. Prior Art

It is a well established phenomena in the digital printer art that print smear between the hard copy printout and type font, such as on a rotating print band, is created by the duration and nature of impact between the hammer and font type. Generally, the greater the effective weight of the hammer, the greater the contact time between the hammer and the type font wherein the type font is pressed against an inked ribbon next to the paper printout. As a result of the finite contact time, a degree of print smear occurs which in some cases can be excessive and destroy or impair the readability of the printed image. Print smear is particularly noticeable as font size decreases and font velocity increases.

Generally, prior art hammer designs, such as shown in FIG. 1, attempted to minimize the effective weight of the hammer and thereby create a shorter contact time on the tip surface 10 of hammer 12 with the font during impact. This was accomplished, as shown in FIG. 1, by reducing the size and mass of body 14 of hammer 12, leaving portions of tip surface 10 cantilevered at a distance from center line 16 of hammer 12. This was particularly the case where, in a multiple spanning hammer, such as a double spanning hammer, the odd and even print positions 18 and 20 may be one-half the total distance of tip surface 10 from center line 16.

FIG. 2A represents a prior art hammer having a flat tip surface 10 just before the moment of impact with a font type 22. FIG. 2B illustrates the impact between surface 10 and a type character "H", thereby imprinting upon a hard copy surface 24 the inked image of the letter "H". If hammer 12 were perfectly rigid, the smear across the letter "H" would be even and a clear character would be produced as shown in FIG. 2B. However, the impact force of hammer 12 causes even edge 26 to be bent away from font type 22 as shown in FIG. 2C in exaggerated form. That portion of the font character furthest from even edge 26 is more smeared than the nearer portions of the font character as shown in FIG. 2C. The degree of smear increases as font speed and impact force increases.

FIG. 2D illustrates the end of impact wherein the printed "H" has a leg 30 substantially thicker than leg 32. Similarly, as shown in FIG. 2E, a font type 22 printed in odd print position 18 will have a mirror image smear such that leg 34 of an "H" will leave a thicker imprint than leg 36.

One of the prior art methods attempted to avoid the smear phenomena illustrated in FIG. 2 by the means shown in FIG. 3. In the prior art embodiment of FIG. 3, hammer 12 was provided with a hammer face configuration such that tip surface 10 was given a longer trailing edge 26 than leading edge 28. The compensatory theory is based on the following observation. As shown in FIG. 4, a frictional stress exerted by the movement of font type 22 against tip surface 10 can be vectorially resolved into a component parallel to deformed surface 40 and a component perpendicular and away therefrom. As a result, the bending stress on even edge 26 is decreased. On the other hand, as shown in FIG. 5, the same frictional force, F, between font type 22 and deformed surface 42 is resolved into a force, Fp, parallel to deformed surface 42 and a perpendicular force, Fn, directed into tip surface 10. As a result, the degree of stress applied to odd edge 28 is greater. Therefore, the amount to which that portion of hammer 12 was cantilevered outward in the proximity of odd print position 18 is decreased relative to the cantilevered projection in the proximity of even print position 20. The object of the modification was to equalize the amount of bending at both even and odd print positions 18 and 20 without reducing or eliminating it. However, unequal print smear still occurs within any given character imprint. However, as it may be readily appreciated, it is extremely difficult to design the resiliency or deformability of a print hammer across a significant range of impact forces and font velocities such that deformation is equalized in a broad range of applications.

The present invention overcomes each of the prior art inadequacies and is adaptable to a broader range of applications with a greater quality of performance.

BRIEF SUMMARY OF THE INVENTION

The present invention is an improvement in a printer which employs a moving type font and at least one impact hammer. The impact hammer is a multiple-type spanning hammer provided with a tip or striking surface. The improvement comprises a concave curvature formed or defined into and by the tip surface whereby the print image formed by impact of the hammer against the moving type font is clarified, and image smear is substantially reduced and controlled.

In one embodiment, the concave curvature defined into the tip surface is a cylindrical radius of curvature. The hammer may have a centerline plane of symmetry and the axis of the cylindrical radius of curvature may lie on the centerline plane extended from the hammer. In addition, the type font used in the printer may have a vertical direction and the axis of the cylindrical radius of curvature may be parallel to the vertical direction of the type font.

In one embodiment, the tip surface has a center and the moving type font assumes a plurality of print positions wherein the spatially averaged location of the plurality of print positions is displaced or offset from the center of the tip surface by a predetermined distance in the direction of travel of the moving type font.

In another embodiment of the present invention, the tip surface has a center and the spatially averaged location of the radii of curvature of the tip surface is displaced from the center of the tip surface by a predetermined distance in the direction of travel of the moving type font. In such a case, the radii of curvature are approximately equal or may be substantially equal and define a cylindrical concave curvature in the tip surface.

In the particular embodiment which is illustrated in the following detailed description, a band printer is assumed as having a plurality of double spanning impact hammers each with a tip surface. It must be understood, however, that slug and other types of printers may also employ hammers incorporating the present invention. The advantages of the present invention and its various embodiments may be better understood by considering the following detailed description in light of the figures.

BRIEF SUMMARY OF THE DRAWINGS

FIGS. 2A–2E is a plan view series showing the impact of a prior art hammer, and its deformation with respect to a moving font character together with the resulting imprint.

FIG. 3 is a simplified diagrammatic view of a prior art embodiment using an asymmetric trailing and leading edge on a print hammer.

FIG. 4 is a plan view showing the resolution of frictional stress between a font character and the tip surface of the impact hammer of FIG. 3 when the hammer is deformed in the even print position.

DETAILED DESCRIPTION OF THE PREFERRED EMBODIMENTS

The present invention includes an apparatus and method wherein an impact hammer is provided with a concave cylindrically ground tip surface. The tip surface is provided with a cylindrical radius of curvature around an axis parallel to the vertical direction of the font height with which the hammer makes contact. For any given hammer design, the radius of curvature is determined by the expected impact force and font velocity according to well known engineering principles or empirical deduction. For example, in one case, a radius of 7 inches is desirable when the impact energy is 65 gm-cm and font velocity is 200 inches/sec. A radius of 10 inches is desirable when impact energy is 50 gm-cm and font velocity is 148 inches/sec. However, the parameters will be different according to the hammer design employed and effective weight of the hammer. The above example pertains to a hammer having an effective weight of 0.95 gm. The lower the impact force and/or font velocity, the larger the radius of curvature which must be employed. The principle, operation and advantages of the present invention are better understood by viewing in detail the sequence of events during an impact between a font character and hammer incorporating the present invention as shown in FIG. 6(A) through FIG. 6(F).

Figure 6A:
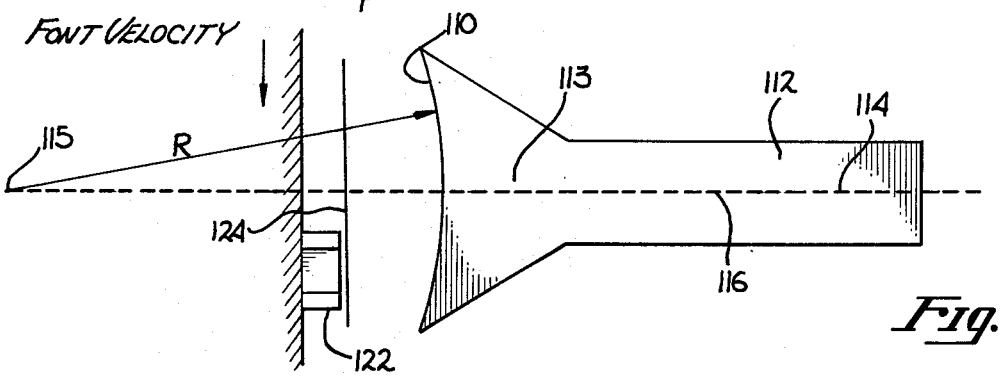
FIGS. 6A–6F is a diagrammatic plan view of the present invention showing impact, deformation and the resulting image in an even and odd print position.

FIG. 6(A) is a simplified diagrammatic view of a hammer 112 having a tip surface 110 formed at the end of cantilevered portions 113 projecting outwardly from a smaller hammer body 114. Tip surface 110 is provided with a concave cylindrical radius of curvature. The axis 115 of the radius of curvature is parallel to the vertical direction of the font type 122 with which the hammer makes contact in order to create an inked impression on a hard copy surface 124. In the embodiment illustrated in FIG. 6, axis 115 lies on the centerline plane 116 which symmetrically divides hammer 112 with mirror symmetry. The particular hammer shape shown in the present embodiment should be understood as being taken only for the purposes of illustration and clarity. It is to be understood that any hammer shape well known to the art or any shape which is subject to leading and trailing edge deformations is to be included. FIG. 6(A) shows hammer 112 approaching font character 122, the alphabetic character "H", prior to impact.

Figure 6B:
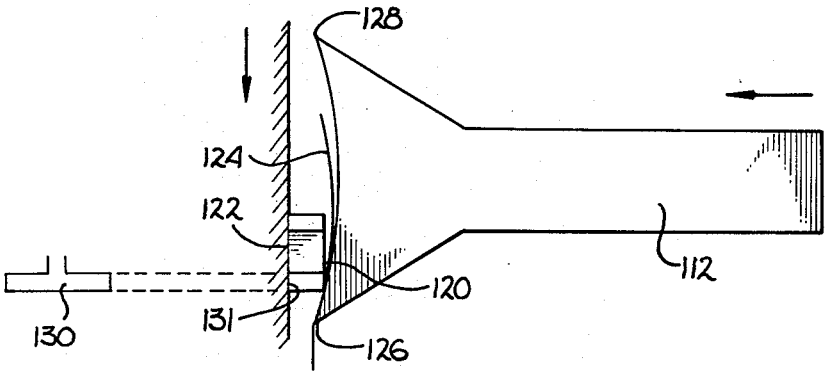

FIG. 6(B) shows hammer 112 of FIG. 6(A) just as even edge 126 makes contact with leg 131 of character 122 to form an image imprint 130 on hard copy 124.

Figure 6C:
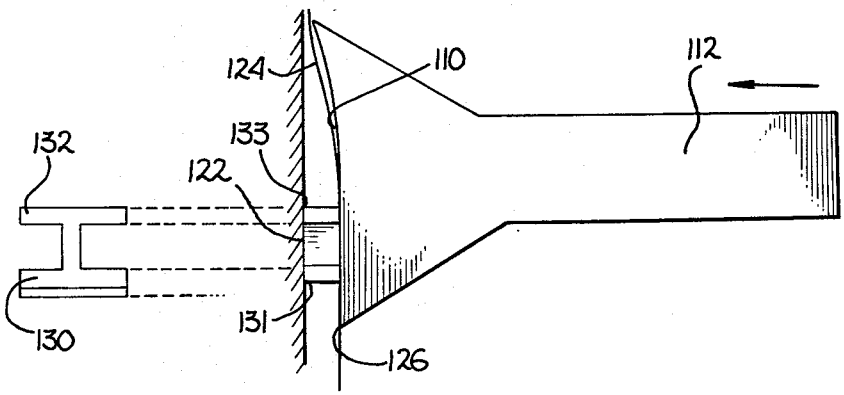

FIG. 6(C) shows hammer 112 of FIG. 6(B) at a subsequent time during impact when even edge 126 begins to deform and tip surface 110 also makes contact with leg 133 of font character 122 to create a second portion 132 of the image imprint. As shown, a first portion 130 of the image imprint will begin to smear and form a thicker image than portion 132.

Figure 6D:
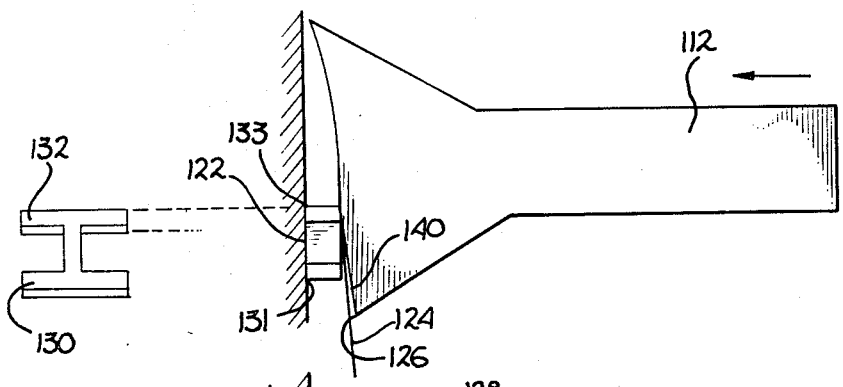

FIG. 6(D) shows hammer 112 of FIG. 6(C) at a subsequent time when even edge 126 continues to deform and form surface 140. Hammer contact is lifted or lessened along leg 131 of font character 122 while it is maintained at a greater magnitude along leg 133. As a result, smearing ceases with respect to portion 130 of the image imprint while smearing begins or continues with respect to portion 132 of the image imprint.

Figure 6E:
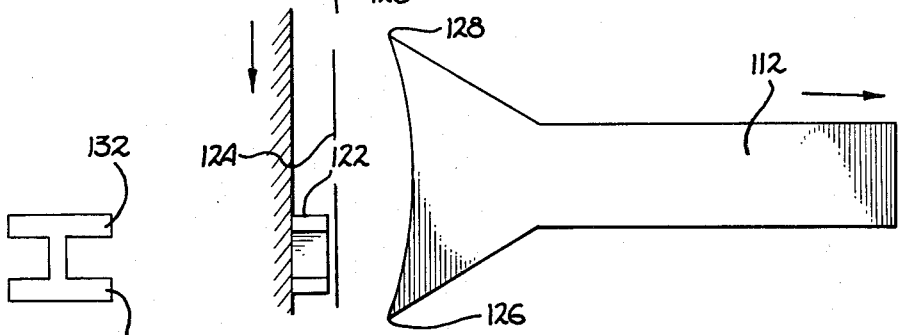
Figure 6F:
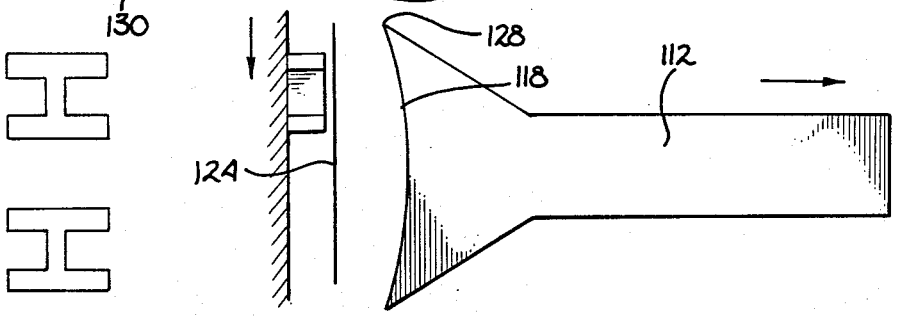

In FIG. 6(E), hammer 112 of FIG. 6(D) is shown at a subsequent time after impact when hammer 112 is moving away from font character 122. The image imprint is left with an equal amount of smear with respect to both portions 130 and 132 of the imprint leaving a clear and uniform printed character on hard copy 124. Similarly, the mirror image deformation and sequence of events will occur with respect to the leading edge 128 of hammer 112 which, after the same series of events, will leave a clear and uniform image after impact when font character 122 is impacted in the odd print position 118 as diagrammatically shown in FIG. 6(F).

Figure 1:
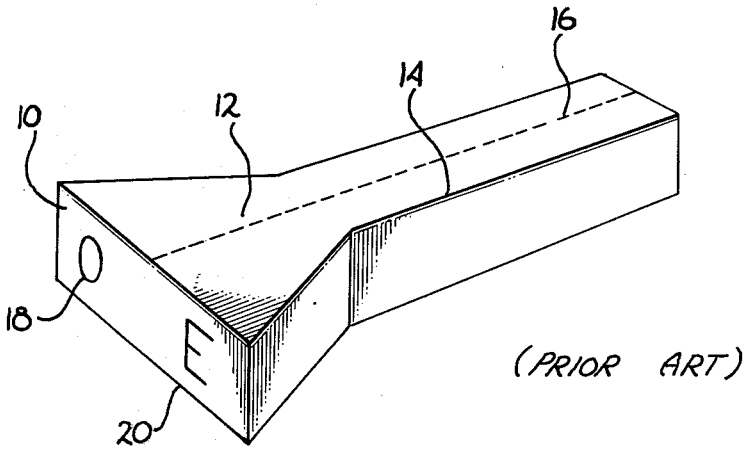
FIG. 1 is a simplified perspective view of a prior art impact hammer.
Figure 2A:
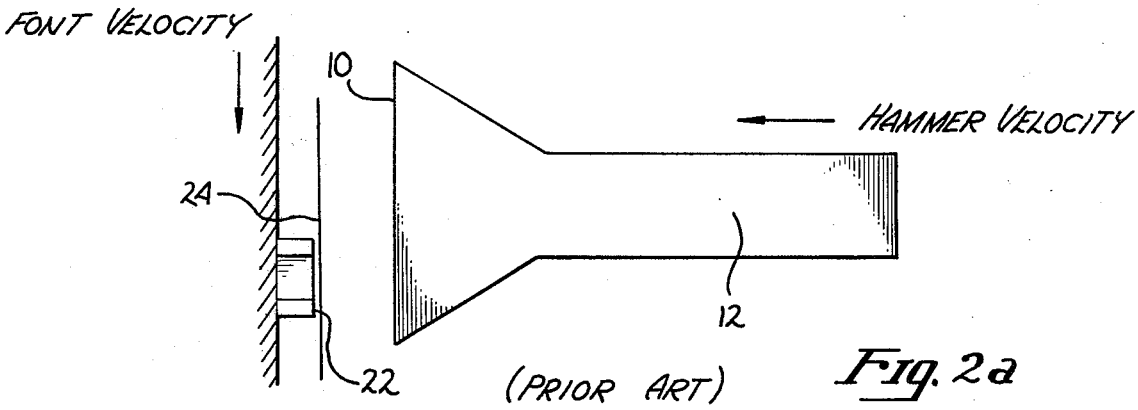
Figure 2B:
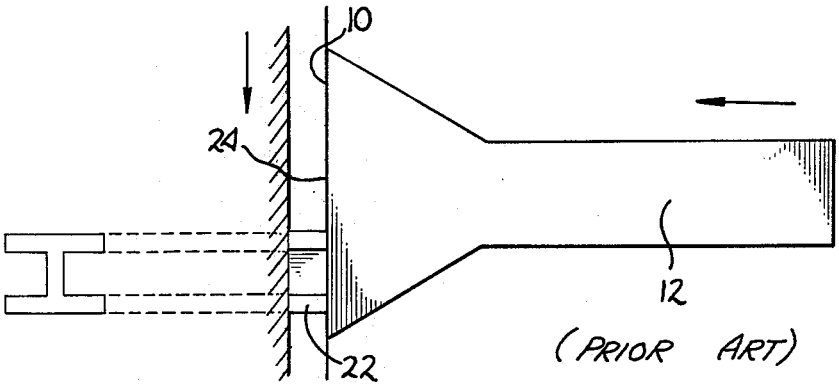
Figure 2C:
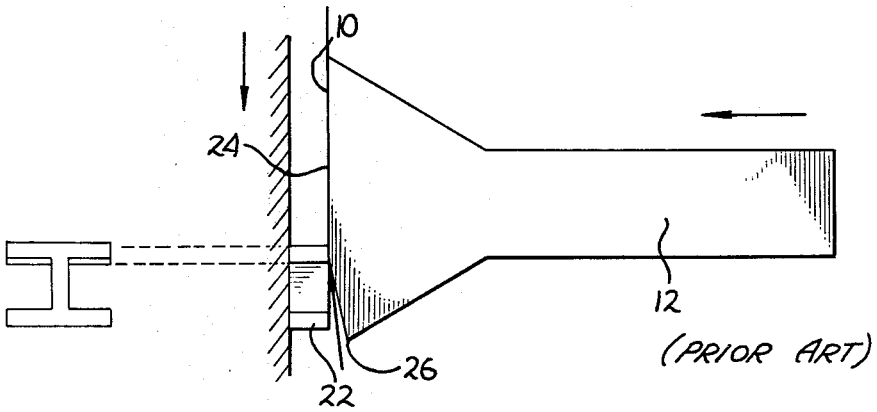
Figure 5:
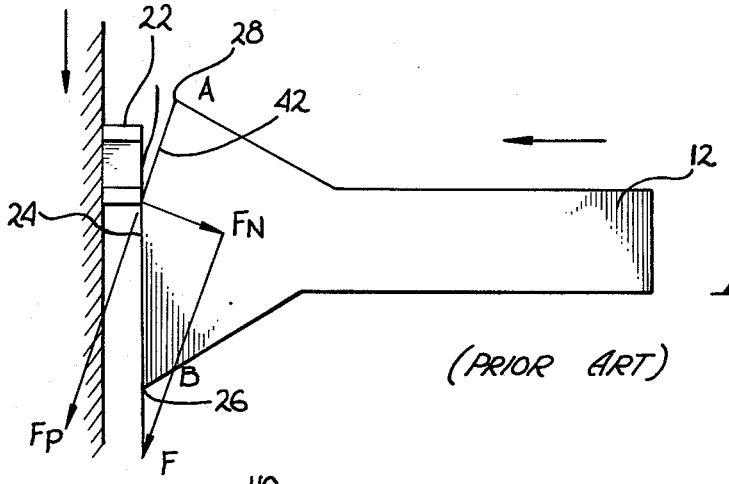
Fig. 5 (PRIOR ART)
FIG. 5 is a diagrammatic plan view of the impact hammer shown in FIGS. 3 and 4 showing the resolution of frictional forces and deformation when impact is made with the font character in the odd print position.
Figure 7:
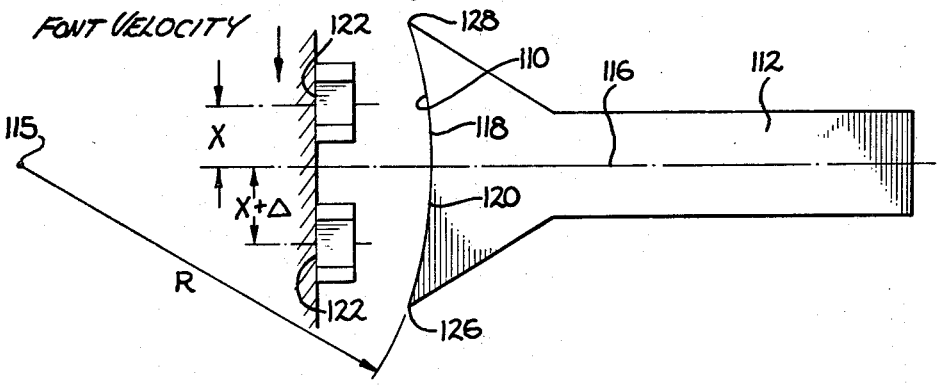
FIG. 7 is another embodiment of the present invention wherein impact is delayed in time in order to offset the print position.

For the reasons discussed in connection with FIGS. 4 and 5, the degree of tip bending will not be equal when edges 126 and 128 are compared because of the contribution made by font velocity in the stresses against tip surface 110. To counteract this effect, the present invention can be ideally adapted as shown in FIG. 7 to time the impact between tip surface 110 and character 122 such that font character 122 is impacted closer to centerline 116 of hammer 112 with respect to leading edge 128 or odd print position 118. Similarly, the impact between font character 122 and tip surface 110 is further from centerline 116 with respect to edge 126 or even print position 120 than for edge 128. Thus, the distance between center line 116 and print position 120 may be $X + \Delta$ while the distance between centerline 116 and print position 118 is X. The amount of offset, $\Delta$, is determined according to font velocity and impact force. The embodiment of FIG. 7 is particularly advantageous in that the compensation made for font velocity can be effected by electronic circuitry in a variable manner as dictated by font velocity and impact force. In this manner, a singly designed hammer can be adjusted for an extremely wide range of applications.

Figure 8:
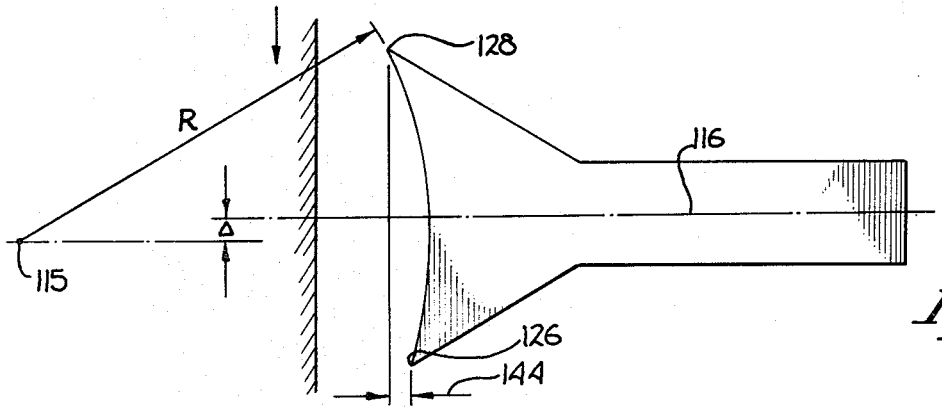
FIG. 8 is another embodiment of the present invention showing a diagrammatic plan view wherein the cylindrical radius of curvature has been offset by a predetermined amount from the center line of the print hammer.

Another embodiment of the present invention is shown in FIG. 8 wherein the effect of font velocity is compensated by offsetting axis of curvature 115 from centerline 116 by a distance, $\Delta$. In the manner as shown in FIG. 8, axis 115 is offset toward trailing edge 126 and away from leading edge 128 thereby resulting in a crown height difference 144 between edge 128 and 126. Leading edge 128 may then suffer a greater deformation equal to double the crown height difference 144 than trailing edge 126 creating thus equal contact time for substantially all portions of font character 122.

It is to be understood that many modifications and alterations may be made by those having ordinary skill in the art without departing from the spirit and scope of the present invention. For example, although the present embodiment has been described in terms of a cylindrical radius of curvature, it is to be understood that the cross section need not be exactly circular and, in fact, may assume any curved shape well known to the art, such as a parabola, ellipse and more irregular concave surfaces. Similarly, the illustration has been shown with respect to a band printer, but it is to be understood that the application may be made to any impact printer type where image smear, due to hammer deformation or font velocity, is a contributing factor. Thus, triple spanning as well as double spanning hammers, or any other type of wide spanning hammer is included within the scope of the present invention. The present invention tends to reduce or compensate for uneven smear, and has been observed to decrease the amount of impact smearing by a factor of approximately one-half for any given impact time as compared to prior art devices. Furthermore, the present invention permits the possibility of adaptation to a large range of hammer designs inasmuch as the hammer tip faces only need to be ground with the proper concave curvature. Other aspects of the hammer design need not be altered. By the simple expedient of changing the grinding radius of the hammer tip surfaces, hammers may readily and easily be fabricated to provide suitable impact over a large range of impact stresses and font velocities.

I claim:

1. In a band printer employing a moving type font moving in a substantially straight direction and employing at least one multiple-type spanning impact hammer having a tip surface, an improvement comprising:

a concave curvature formed into said tip surface, said hammer having a centerline plane of symmetry, said tip surface having an inherent resiliency, the axis of curvature of said tip lying in said centerline plane, said axis of curvature being substantially orthogonal to said straight direction of movement of said moving type font, and wherein:

said type font assumes first and second print positions along said straight direction of movement, said font being impactable by a portion of said hammer tip surface which is situated on one side of said centerline plane when in said first print position and being impactable by a portion of said hammer tip surface which is situated on the other side of said centerline plane when in said second position, and wherein:

the locations of said first and second print positions are respectively offset from said centerline plane by different predetermined distances along said straight direction of movement of said moving type font, whereby print image smear is substantially reduced and controlled.

2. In a band printer employing a moving type font moving in a substantially straight direction and employing at least one multiple-type spanning impact hammer having a tip surface, an improvement comprising:

a concave curvature formed into said tip surface, said hammer having a centerline plane, said tip surface having an inherent resiliency, the axis of curvature of said tip surface being substantially orthogonal to said straight direction of movement of said moving type font, and wherein:

said axis of curvature of said tip surface is displaced from said centerline plane by a predetermined distance in the direction of travel of said moving type font.

3. In a band printer employing a plurality of double spanning impact hammers each having a tip surface and a font moving at least in part in a straight direction, the improvement wherein:

the tip surface of each double spanning impact hammer has a concave curvature, wherein each said tip surface is resilient, wherein each one of said double spanning impact hammers has a centerline plane substantially coincident with a plane of mirror symmetry of that hammer, the axis of curvature of said tip surface lying on said centerline plane, and wherein:

for each of said hammers said band printer has an even print position and an odd print position at which said font may be impacted by the corresponding hammer tip surface, said even and odd print positions both being situated along said straight direction of motion of said font but on opposite sides of said centerline plane, the spatially averaged location of said even and odd print positions being displaced from said centerline plane by a predetermined distance along said straight direction of motion of said moving font.

4. The improvement of claim 3 wherein said odd print position is situated on the side of said centerline plane from which said moving font approaches said centerline plane, and wherein the distance between the location of said odd print position and said centerline plane is less than the distance from said centerline plane to said even print position.

5. In a band printer employing a plurality of double spanning impact hammers each having a tip surface and a moving font defining a straight direction of movement, the improvement wherein:

the tip surface of each of said double spanning impact hammers is resilient and has a concave curvature, each of said double spanning impact hammers having a centerline plane, and wherein:

the axis of curvature of the tip surface of each hammer is displaced from the centerline plane of that hammer by a predetermined distance in a direction parallel to said straight direction of movement defined by said moving font, whereby print smear due to movement of said font is substantially reduced and controlled.

* * * * *